US006019372A

United States Patent [19]

Polaski et al.

[11] Patent Number: 6,019,372

[45] Date of Patent: Feb. 1, 2000

[54] RHYMING WORD GAME

[76] Inventors: Richard Frank Polaski, 2064 Arnold Acres Dr., Pittsburgh, Pa. 15205; Michael William Nield, 315 McCaffrey Dr., Coraopolis, Pa. 15108; Linda Tobias Polaski, 2064 Arnold Acres Dr., Pittsburgh, Pa. 15205; Robin Maura Nield, 315 McCaffrey Dr., Coraopolis, Pa. 15108

[21] Appl. No.: 09/028,827

[22] Filed: Feb. 24, 1998

[51] Int. Cl.[7] ..... A63F 3/00

[52] U.S. Cl. ..... 273/272; 273/431

[58] Field of Search ..... 273/272, 299, 273/430, 431, 432

[56] References Cited

U.S. PATENT DOCUMENTS

| | | |
|---|---|---|
| 4,306,725 | 12/1981 | Sawyer . |
| 5,120,066 | 6/1992 | Cohen . |
| 5,145,184 | 9/1992 | Yearick et al. . |
| 5,211,402 | 5/1993 | Ferguson et al. . |
| 5,248,148 | 9/1993 | Toan . |
| 5,441,277 | 8/1995 | Lenhart et al. . |

*Primary Examiner*—William M. Pierce
*Attorney, Agent, or Firm*—Alan G. Towneer; David C. Jenkins; Eckert Seamans Cherin & Mellott, LLC

[57] ABSTRACT

A rhyming word game including a game board having a plurality of advancement zones which contain a plurality of advancement positions defining a movement path. At the base of each advancement zone is a start position. All advancement zones lead to a mutual finish position in the center of the game board. There are a number of game pieces which are positionable on each of the plurality of advancement positions for movement from the start position to the finish position. There are a number of playing cards which have a plurality of clues and a corresponding number of rhyming answers. The answers are definitions, interpretations, or associations of the clues. There also exists a timing apparatus used to limit the amount of time players have to respond with the correct rhyming answers to the given clues from the playing cards. The time varies according to the position of a player's game piece on the game board. When players respond with the correct rhyming answers within the allotted time, they advance one position toward the finish position. The first player to advance to the finish position wins the game.

18 Claims, 3 Drawing Sheets

RHYMING WORD GAME

BACKGROUND OF THE INVENTION

1. Field of the Invention

This invention is related to a rhyming word game, an apparatus to measure progress, components adapted for executing the rhyming word game, and a method of playing such.

2. Background of the Invention and Prior Art

Many word games are known wherein a player's advancement to a winning position depends to a great extent on a player's knowledge in a particular subject. Examples of such word games include U.S. Pat. No. 4,306,725, a thesaurus card game utilizing dictionary definitions; U.S. Pat. No. 5,120,066, another thesaurus game that tests a player's ability to match key words or symbols to one or more other words or symbols; and U.S. Pat. No. 5,211,402, an analogy game that expands players' vocabulary and general knowledge by drawing analogies between people, events, places, things, and concepts. However, there are very few board games where advancement depends on rhyming word responses. Two examples of rhyming word board games are U.S. Pat. No. 5,441,277 and U.S. Pat. No. 5,248,148.

U.S. Pat. No. 5,248,148 is an educational word rhyming game that uses rhyming cards depicting drawings and words and a spinner to determine the number of rhymes one player must form from the selected rhyming card. The player advances along a plurality of consecutive spaces defining a movement path toward a finish space. The main purpose of this invention is for educational value. While this game may provide some educational value, its simplistic nature is directed toward a very young audience.

U.S. Pat. No. 5,441,277 is a board game that tests a player's knowledge of musical and literary works and requires a player to recite or create a rhyming response. The game board consists of a plurality of distinguishable spaces that are divided into several categories requiring a player to comply with a particular instruction. The particular instruction occurs on a randomly selected playing card chosen by the player. The player advances on the game board by complying with the instruction in the recitation or creation of rhyming word or words. The words may be included in a poem, a multiple-line rhyme, ending lines of a sentence, a lyric, or a greeting card message. This may be done with a time constraint provided by a timing apparatus. The player having completed the instruction moves along the game board toward the winning space. While the game provides a variety of playing categories, it is this variety of categories that creates a complex and lengthy set of instructions. In addition, the game does not allow for simultaneous participation among all players. In certain instances, a player dominates the game by continually responding correctly. This temporarily suspends others from play.

While many such educational and knowledge testing games are known, there is an unsolved need for some method of developing a rhyming word game that uses general knowledge to provide entertainment for the family in a more interactive manner. The present invention is a result of a concern for a game that is entertaining, highly interactive, and challenging while utilizing general knowledge and providing some degree of education to all players.

SUMMARY OF THE INVENTION

The invention has met the above needs. The present invention is a result of a concern for a game that is entertaining, highly interactive, and challenging while utilizing general knowledge and providing some degree of education to all players.

The present invention creates a rhyming word game which avoids the drawbacks of prior art rhyming word games.

The present invention adapts to a broad audience. The present invention is geared for an audience ranging from adolescent to adult, but it can also be geared to a preadolescent audience of reading age.

The present invention provides a rhyming word game that is entertaining, simple to understand, and easy to play.

The present invention provides a rhyming word game that can be played by two or more players providing social interaction between friends and family.

The present invention also provides a rhyming word game that maintains the interest of all players by continuous interactive participation.

The present invention further provides a rhyming word game that utilizes a time limitation creating a level of intensity that makes the game fast paced and exciting.

The present invention still further provides a rhyming word game that is educational in nature by increasing vocabulary skills, testing general word knowledge and word association, and utilizing creative and logical thinking.

An object of the present invention is to provide a rhyming word game in which a player responds to clues with rhyming answers. The rhyming word game includes means for displaying multiple clues, and means for displaying multiple rhyming answers derived from the clues.

Another object of the present invention is to provide a method of playing a rhyming word game. The method includes the steps of providing multiple clues, and answering the multiple clues with multiple rhyming answers derived from the clues.

In the description of the preferred embodiment of the present invention, the rhyming word game includes a game board having a plurality of advancement zones which contain a plurality of advancement positions defining a movement path. At the base of each advancement zone is a start position. All advancement zones lead to a mutual finish position in the center of the game board. There are a number of game pieces which are positionable on each of the plurality of advancement positions for movement from the start position to the finish position. There are a number of playing cards which have a plurality of clues and a corresponding number of rhyming answers. The answers are definitions, interpretations, or associations of the clues. There also exists a timing apparatus used to limit the amount of time players have to respond with the correct rhyming answers to the given clues from the playing cards. The time varies according to the position of a player's game piece on the game board. When players respond with the correct rhyming answers within the allotted time, they advance one position toward the finish position. The first player to advance to the finish position wins the game.

Further advantages as well as other variations of the invention will become apparent from consideration of the drawings and the ensuing description.

DETAILED DESCRIPTION OF THE PREFERRED EMBODIMENT

Figure 1:
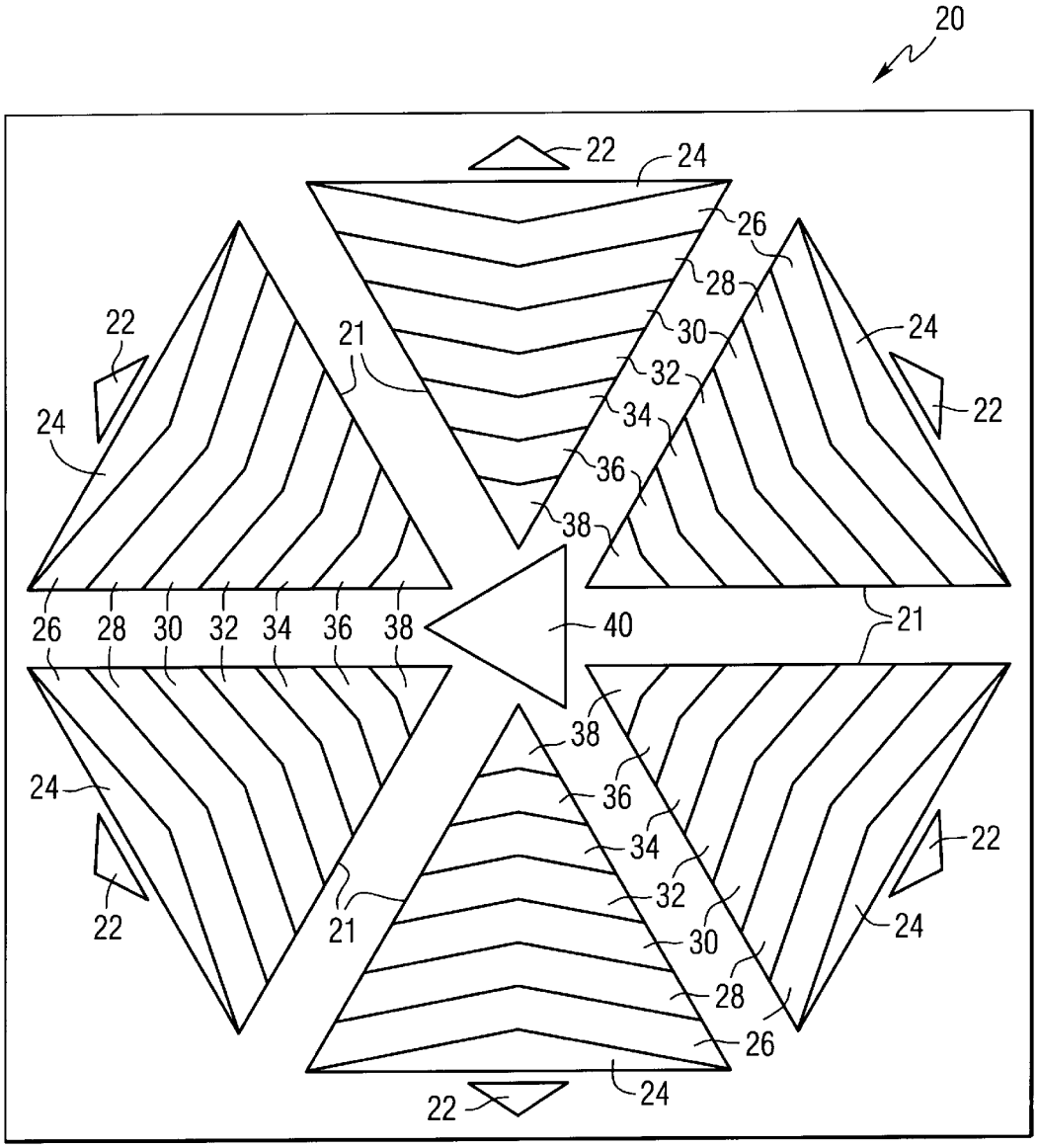
FIG. 1 is a plan view of a preferred embodiment of a game board according to the invention.
Figure 3:
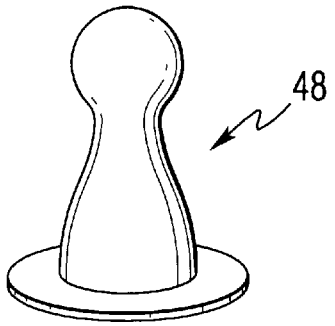
FIG. 3 is a perspective view of a preferred embodiment of a game piece that is advanced from a start position to a finish position forming part of the rhyming word game according to the invention.

FIG. 1, shows a game board 20 for use in a preferred embodiment of a rhyming word game. Game board 20 shows a plurality of advancement zones 21. At the base of each advancement zone 21 is a start position 22. In the center of the game board 20, at the peak of all the advancement zones 21 is the finish position 40. Contained within each advancement zone 21 is a plurality of advancement positions 24–38. The movement path for a game piece 48, shown in FIG. 3, is from a start position 22 through each advancement position 24–38 within an advancement zone 21 to the finish position 40.

FIGS. 2–5 Illustrate other basic components of the preferred embodiment of the rhyming word game according to the invention.

Figure 2A:
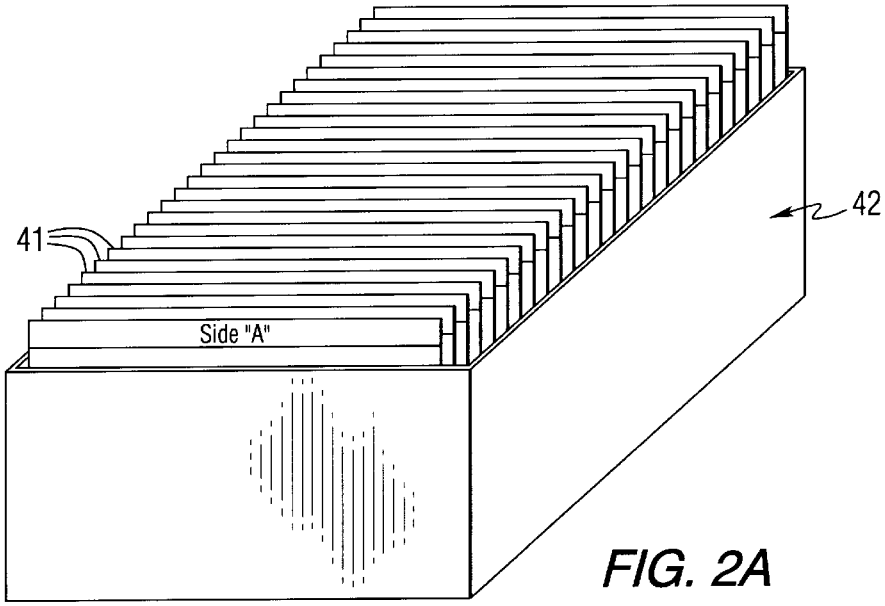
FIG. 2A is a perspective view of a preferred embodiment of a box containing a deck of individual playing cards forming a part of the rhyming word game according to the invention.

FIG. 2A is a box 42 containing a deck of individual playing cards 41.

Figure 2B:
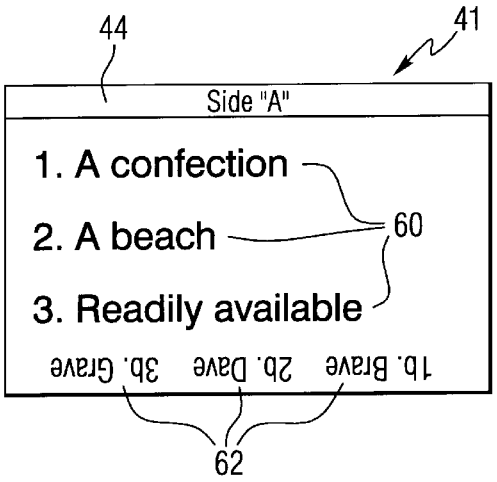
FIG. 2B is a plan view of a preferred embodiment of one side of a two-sided playing card removed from the deck of playing cards shown in FIG. 2A forming a part of the rhyming word game according to the invention.
Figure 2C:
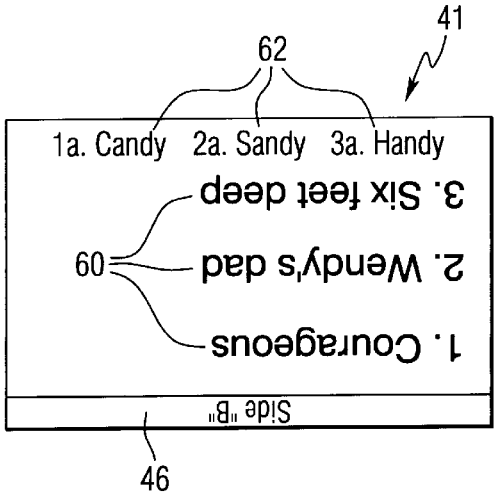
FIG. 2C is a plan view of a preferred embodiment of the opposite side of FIG. 2B forming a part of the rhyming word game according to the invention.

FIG. 2B–2C are plan views of an individual playing card 41 depicting the front of the card 44, and the back of the card 46. Each side of a playing card 44 and 46 includes a plurality of clues 60 printed thereon and a plurality of answers 62 printed thereon upside down. The corresponding answers 62 to the clues 60 on one side of a playing card 44 are found on the reverse side of the same playing card 46. In the same way, the corresponding answers 62 to the clues 60 on one side of a playing card 46 are found on the reverse side of the same playing card 44.

FIG. 3 is a perspective view of a preferred embodiment of a game piece 48 which is moved on game board 20, shown in FIG. 1, from start space 22 to finish position 40. Each game piece 48 is distinguishable by color from an opponent's game piece 48.

Figure 4:
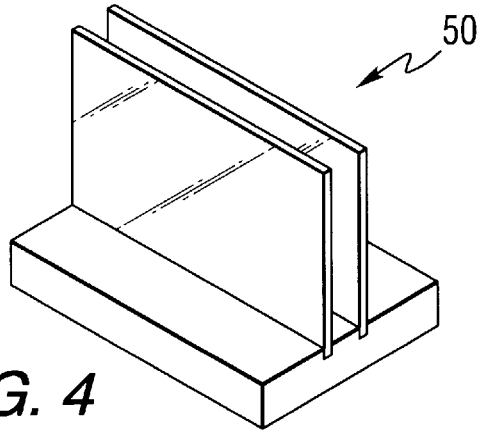
FIG. 4 is a perspective view of a preferred embodiment of a card holder for the card shown in FIG. 2B and FIG. 2C forming part of the rhyming word game according to the invention.

FIG. 4 is a perspective view of a preferred embodiment of a card holder 50 used to support a playing card 41 in FIG. 2B and FIG. 2C.

Figure 5:
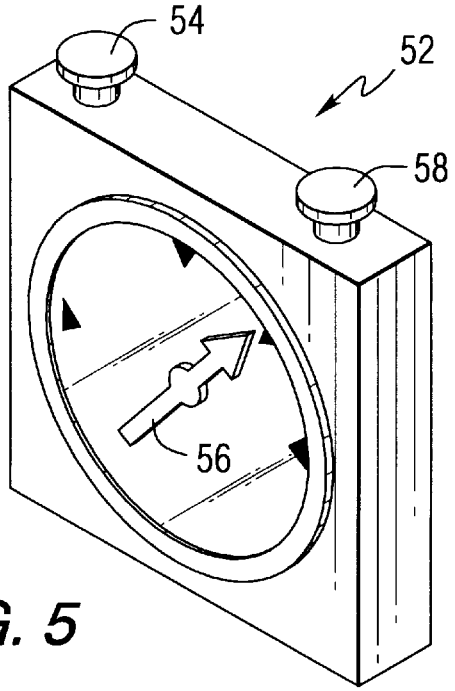
FIG. 5 is a perspective view of a preferred embodiment of a timing apparatus used to limit the time that a player has to respond according to the operation of the game forming part of the rhyming word game according to the invention.

FIG. 5 is a perspective view of a preferred embodiment of a timing apparatus 52 which has a start mechanism 54, a time selecting mechanism 56, and a stop mechanism 58.

OPERATION OF THE INVENTION

The object of the game is to be the first player or team to advance their game piece 48 to the finish position 40 in the center of the game board 20. Advancement is accomplished by responding to the clues 60 with the correct rhyming answers 62 within a specific time limit.

To begin play, the game board 20 is preferably placed on a flat surface. A player or team of players selects a colored game piece 48 and places it on one of the start positions 22 located at the base of each advancement zone 21.

Choose a player who will act as a facilitator for the first round. The facilitator's function is to set the timing apparatus 52, provide the clues 60, and indicate correct or incorrect rhyming answers 62 for the other players. The facilitator's responsibilities are usually passed clockwise to the next player for each subsequent round. The player to the left, or clockwise from the facilitator, is known as Player-One. Player-One is normally the player who gets the first opportunity to respond with the rhyming answers.

The game is comprised of three distinct types of rounds: a regular round, a clue round, and a winning round. The location of Player-One on game board 20 within the advancement zone 21 determines whether a round is a regular round or a winning round. A regular round occurs whenever Player-One is located on start position 22 or on an advancement position 24–36. A winning round occurs only when Player-One is located on advancement position 38. A clue round can occur within a regular round or a winning round.

Regular Round

During a regular round, the facilitator selects an individual playing card 41 from the box 42 and keeps the answers 62 hidden from the view of the other players. The facilitator uses the time selecting mechanism 56 to set the timing apparatus 52 to the time indicated by the position of the game piece 48 on the game board 20. The facilitator then reads the clues 60 aloud, activates the start mechanism 54, places the individual playing card 41 into the card holder 50 so the clues 60 are visible to all the players and the rhyming answers 62 are only visible to the facilitator.

All players participate during a regular round, but the player to the left of the facilitator becomes Player-One and gets the first opportunity to guess the rhyming answers 62 to the clues 60. Player-One must give the correct rhyming answers 62 within the time indicated on the advancement position 24–38 to which Player-One is trying to advance.

If Player-One answers correctly, Player-One advances one advancement position 24–38 toward the finish position 40. This ends the round.

If Player-One does not answer within the specified time or answers incorrectly, the facilitator immediately asks the next player clockwise from Player-One for the correct rhyming answers. The facilitator continues this process until one of the players gives the correct rhyming answers 62 or all players have had an opportunity to respond.

If any other player responds with the correct rhyming answers and is not located on advancement position 38, this player moves forward one advancement position 24–38 and the round ends.

If any other player responds with the correct rhyming answers and is located on advancement position 38, the round ends and this player becomes Player-One for the next round. The person to the right of this player becomes the new facilitator. No advancement occurs in this situation, but it gives this player the opportunity to win the game in the next round.

Anytime a player responds, but does not give all the correct rhyming answers 62, that player must move back one advancement position 36–24, or back to START position 22. If a player is in the START position 22, that player remains there. A player is not penalized for not responding.

Clue Round

If no player has given the correct rhyming answers 62 during the regular round, the round becomes a clue round. A clue round is played as a "free-for-all" format (a "free-for-all" is when all players compete simultaneously to guess the rhyming answers 62). The facilitator uses the time selecting mechanism 56 to set the timing apparatus 52 to the predetermined time specific to a clue round, selects and reads one of the rhyming answers 62, and activates the start mechanism 54. The objective of the facilitator is to stump the other players by using a strategy in choosing which answer 62 to give. Usually the most obvious rhyming answer 62 should be chosen.

As soon as any player knows the remaining rhyming answers, they signal the facilitator. The facilitator stops the timing apparatus 52 by activating the stop mechanism 56 and the player must immediately respond with the correct rhyming answers 62.

If any player responds with the correct rhyming answers and is not located on advancement position 38, this player moves forward one advancement position 24–38 and the round ends.

If any player responds with the correct rhyming answers and is located on advancement position 38, the round ends and this player becomes Player-One for the next round. The person to the right of this player becomes the new facilitator. No advancement occurs in this situation, but it gives this player the opportunity to win the game in the next round.

If the facilitator indicates the answers are incorrect, the player who answered incorrectly is eliminated from the round, the facilitator reactivates the start mechanism 54 on the timing apparatus 52, and the other players get a chance to answer within the remaining time. This process continues until all remaining time expires.

If all players fail to answer correctly in the remaining time and the facilitator is not located on advancement position 38, the facilitator moves forward one advancement position 24–38 and the round ends.

If the facilitator is located on advancement position 38, the round ends and the facilitator becomes Player-One for the next round. The person to the right of the facilitator becomes the new facilitator. No advancement occurs in this situation, but it gives the facilitator the opportunity to win the game in the next round. This ends the round.

Anytime a player responds and does not give all the correct rhyming answers 62, that player must move back one advancement position 36–24, or back to START position 22. If a player is in the START position 22, that player remains there. A player is not penalized for not responding.

Winning Round

A regular round becomes a winning round when Player-One is poised to win the game by being located at the top of the advancement zone 21 in advancement position 38 when starting a new round. Only Player-One can win the game. The round starts when the facilitator selects an individual playing card 41 from the box 42 and keeps the answers 62 hidden from the view of the other players. The facilitator uses the time selecting mechanism 56 to set the timing apparatus 52 to the time indicated by the position of the game piece 48 on the game board 20. The facilitator then reads the clues 60 aloud, activates the start mechanism 54, places the individual playing card 41 into the card holder 50 so the clues 60 are visible to all the players and the rhyming answers 62 are only visible to the facilitator. Because Player-One can win at this point, the other players attempt to block Player-One by competing in a "free-for-all" format (a "free-for-all" is when all players compete simultaneously to guess the answers 62). As soon as a player knows the answers 62, this player signals the facilitator. The facilitator stops the timing apparatus 52 by activating the stop mechanism 56 and the player must immediately respond with the correct answers 62.

If Player-One responds correctly, Player-One advances into the finish position 40 and wins the game.

If any other player responds correctly and is not located on advancement position 38, this player moves forward one advancement position 24–38 and the round ends.

If any other player responds correctly and is located on advancement position 38, the round ends and this player becomes Player-One for the next round. The person to the right of this player becomes the new facilitator. No advancement occurs in this situation, but it gives this player the opportunity to win the game in the next round.

If no player has given the correct answers 62 during the winning round, the round becomes a clue round. A clue round is played as a "free-for-all" format (a "free-for-all" is when all players compete simultaneously to guess the answers 62). The facilitator uses the time selecting mechanism 56 to set the timing apparatus 52 to the predetermined time specific to a clue round, selects and reads one of the rhyming answers 62, and activates the start mechanism 54. The objective of the facilitator is to stump the other players by using a strategy in choosing which answer 62 to give. Usually the most obvious answer 62 should be chosen.

As soon as any player knows the remaining answers, they signal the facilitator. The facilitator stops the timing apparatus 52 by activating the stop mechanism 56 and the player must immediately respond with the correct rhyming answers 62.

If Player-One responds correctly, Player-One advances into the finish position 40 and wins the game.

If any other player responds correctly and is not located on advancement position 38, this player moves forward one advancement position 24–38 and the round ends.

If any other player responds correctly and is located on advancement position 38, the round ends and this player becomes Player-One for the next round. The person to the right of this player becomes the new facilitator. No advancement occurs in this situation, but it gives this player the opportunity to win the game in the next round.

If the facilitator indicates the answers are incorrect, the player who answered incorrectly is eliminated from the round, the facilitator reactivates the start mechanism 54 on the timing apparatus 52, and the other players get a chance to answer within the remaining time.

If Player-One responds correctly, Player-One advances into the finish position 40 and wins the game.

If any other player responds correctly and is not located on advancement position 38, this player moves forward one advancement position 24–38 and the round ends.

If any other player responds correctly and is located on advancement position 38, the round ends and this player becomes Player-One for the next round. The person to the right of this player becomes the new facilitator. No advancement occurs in this situation, but it gives this player the opportunity to win the game in the next round.

If all players fail to answer correctly in the remaining time and the facilitator is not located on advancement position 38, the facilitator moves forward one advancement position 24–38 and the round ends.

If the facilitator is located on advancement position 38, the round ends and the facilitator becomes Player-One for the next round. The person to the right of the facilitator becomes the new facilitator. No advancement occurs in this situation, but it gives the facilitator the opportunity to win the game in the next round. This ends the round.

Anytime a player responds and does not give all three correct answers 62, that player must move back one advancement position 36–24, or back to START position 22. If a player is in the START position 22, that player remains there. A player is not penalized for not responding.

Accordingly, the reader will see the present invention is a rhyming word game that is entertaining, strongly interactive, and challenging while utilizing general knowledge and providing some degree of education to all players. Furthermore, the rhyming word game provides additional advantages in that it allows for a rhyming word game that is simple to understand and easy to play; is adaptable to a broad age group from preadolescent to adult; allows for a rhyming word game that can be played by two or more players providing social interaction between friends and family; utilizes a time limitation creating a level of intensity that makes the rhyming word game fast paced and exciting; and tests word association skills by utilizing creative and logical thinking.

Although this invention has been described above as having a preferred embodiment, it should not be construed as limiting the scope of the invention, but as merely providing an illustration. The game could be displayed on a television screen or other monitor and could be provided in a CD version, VCR version, computer version, and other formats known by those skilled in the art.

Likewise, the preferred embodiment utilizes a facilitator, a Player-One, and three distinctive rounds. However, it should be understood that these elements are not a primary necessity to this game. For example, clues could be presented by any player while the other players receive credit when they respond with the correct rhyming answers.

While the preferred embodiment of the invention describes a game board with a plurality of starting positions, a plurality of advancement zones, and a mutual finish position, it should be understood that any marking indicia indicating where a player starts, advances, and finishes may be utilized. For example, the game board could be replaced by a collection of a specific number of objects. All players start with no objects. As the game proceeds, players show advancement by accumulating objects until one player accumulates the specified number of objects and wins the game.

Furthermore, the playing cards described in the preferred embodiment of the invention can be substituted with a variety of methods for providing the clues and the answers such as a video screen, an audio device, a booklet, etc. Furthermore, while the playing cards show three clues and three answers, any number of clues and answers may be used and the number of answers in relationship to the number of clues does not necessarily have to be equal.

Similarly, it should be understood that the timing apparatus used for this game could differ from the timing apparatus described in the preferred embodiment. For example, a sand timer, a digital timer, a stopwatch, or any device used to limit a player's time to respond can be utilized.

Furthermore, while a timing apparatus is used in the preferred embodiment, this invention is not dependent upon such a device. Thus, the scope of this game is not limited to a timing feature and can be played without any time limitations.

It is understood that this invention is capable of further modifications, uses, and/or adaptations following, in general, the principle of the invention and including such departures from the present disclosure as come within the known or customary practice in the art to which the invention pertains and as may be applied to the central features hereinbefore set forth, and fall within the scope of the invention and of the limits of the appended claims. Therefore, the scope of the invention should be determined by the appended claims and their legal equivalents, rather than by the examples given.

We claim:

1. A method of playing a rhyming word game comprising:

(a) providing a plurality of clues which do not rhyme with each other; and (b) answering said plurality of clues with a plurality of rhyming answers derived from said clues wherein said rhyming answers rhyme with each other and said rhyming answers do not rhyme with said clues.

2. The method of claim 1, further comprising deriving and providing the rhyming answers from definitions, interpretations or associations of said clues.

3. The method of claim 1, further comprising measuring advancement when a player correctly responds with the plurality of rhyming answers.

4. The method of claim 3, wherein said advancement is measured by a plurality of distinct positions including a starting position, a finish position, and at least one advancement position between said starting and finish positions.

5. The method of claim 4, further comprising limiting said player's response time.

6. The method of claim 4, further comprising identifying individual players and indicating advancement between said starting and finish positions for said individual players.

7. The method of claim 3, further comprising:

(a) providing game board means including:

(i) a plurality of advancement zones that contain individual advancement positions which define individual movement paths and indicate response time limits;

(ii) a plurality of start positions located at a base of each said advancement zone; and (iii) a finish position located in the center of said game board at a peak of said advancement zones;

(b) providing a plurality of distinguishable game pieces which identify individual players and indicate the location of each said player on each of said plurality of advancement positions within said advancement zones for movement from said start position to said finish position;

(c) providing a deck of individual playing cards wherein each side of said playing cards includes a plurality of clues printed thereon and a plurality of answers printed thereon;

(d) providing a card holder used to support and display said playing card; and (e) providing a timing apparatus used to limit said player's response time determined by the position of said player's game piece on said advancement position within said advancement zone.

8. The method of claim 7, further comprising:

(a) assigning each said player a said game piece and positioning all said game pieces on said start positions;

(b) determining which of said players is a round facilitator, a first player, or a Player-One, and a sequence of play;

(c) selecting said playing card from said deck of playing cards by said round facilitator;

(d) presenting said clues to all said players by said round facilitator;

(e) setting said timing apparatus by said round facilitator to a length of time as indicated on said game board to limit said player's response time;

(f) having said player attempt to answer correctly said clues from said playing card;

(g) providing rhyming answers within said time limit by said player using definitions, interpretations, or associations of said clues;

(h) validating said rhyming answers by said round facilitator by comparing said player's rhyming answers to said rhyming answers displayed on said individual playing card;

(i) moving said player's said game piece forward toward said finish position when said player responds correctly with said rhyming answers; and (j) moving said player's said game piece backward toward said start position when said player responds incorrectly with said rhyming answers.

9. The method of claim 8, further comprising:

(a) providing one of the said rhyming answers by said round facilitator for continuation of play when said players fail to provide said rhyming answers in the time allotted;

(b) setting said timing apparatus by said round facilitator to a predetermined time;

(c) allowing all players to compete simultaneously to respond correctly with the remaining said rhyming answers;

(d) moving said player's said game piece forward toward said finish position when said player responds correctly with said rhyming answers; and (e) moving said round facilitator's said game piece forward toward said finish position when all said players fail to respond correctly with said rhyming answers.

10. The method of claim 8, wherein said player can only advance to the winning position when said player is Player-One, is positioned at a top of the advancement zone, and is the first player to respond correctly with all said rhyming answers within said length of time designated on said game board.

11. A method of playing a rhyming word game among a plurality of players comprising:

(a) providing a plurality of clues to said players;

(b) said players answering said plurality of clues with a plurality of rhyming answers derived from said clues wherein said rhyming answers rhyme with each other, (c) providing one of the said plurality of rhyming answers for continuation of play when said players fail to provide said rhyming answers.

12. The method of claim 11, further comprising deriving the rhyming answers from definitions, interpretations or associations of said clues.

13. The method of claim 12, further comprising measuring advancement when a player correctly responds with the plurality of rhyming answers.

14. The method of claim 13, wherein said advancement is measured by a plurality of distinct positions including a starting position, a finish position, and at least one advancement position between said starting and finish positions.

15. The method of claim 14, further comprising limiting said player's response time.

16. The method of claim 14, further comprising identifying individual players and indicating advancement between said starting and finish positions for said individual players.

17. The method of claim 13, further comprising:

(a) providing game board means including:

(i) a plurality of advancement zones that contain individual advancement positions which define individual movement paths and indicate response time limits;

(ii) a plurality of start positions located at a base of each said advancement zone; and (iii) a finish position located in the center of said game board at a peak of said advancement zones;

(b) providing a plurality of distinguishable game pieces which identify individual players and indicate the location of each said player on each of said plurality of advancement positions within said advancement zones for movement from said start position to said finish position;

(c) providing a deck of individual playing cards wherein each side of said playing cards includes a plurality of clues printed thereon and a plurality of answers printed thereon;

(d) providing a card holder used to support and display said playing card; and (e) providing a timing apparatus used to limit said player's response time determined by the position of said player's game piece on said advancement position within said advancement zone.

18. The method of claim 17, further comprising:

(a) assigning each said player a said game piece and positioning all said game pieces on said start positions;

(b) determining which of said players is a round facilitator, a first player, or a Player-One, and a sequence of play;

(c) selecting said playing card from said deck of playing cards by said round facilitator;

(d) presenting said clues to all said players by said round facilitator;

(e) setting said timing apparatus by said round facilitator to a length of time as indicated on said game board to limit said player's response time;

(f) having said player attempt to answer correctly said clues from said playing card;

(g) providing rhyming answers within said time limit by said player using definitions, interpretations, or associations of said clues;

(h) validating said rhyming answers by said round facilitator by comparing said player's rhyming answers to said rhyming answers displayed on said individual playing card;

(i) moving said player's said game piece forward toward said finish position when said player responds correctly with said rhyming answers; and (j) moving said player's said game piece backward toward said start position when said player responds incorrectly with said rhyming answers.

* * * * *